US009597921B2

(12) United States Patent
Branch

(10) Patent No.: US 9,597,921 B2
(45) Date of Patent: Mar. 21, 2017

(54) APPARATUS FOR SELECTABLY PROVIDING MULTIPLE COLORS OF INK FROM A MARKER PEN

(71) Applicant: Benjamin Branch, Kalamazoo, MI (US)

(72) Inventor: Benjamin Branch, Kalamazoo, MI (US)

( * ) Notice: Subject to any disclaimer, the term of this patent is extended or adjusted under 35 U.S.C. 154(b) by 532 days.

(21) Appl. No.: 13/946,100

(22) Filed: Jul. 19, 2013

(65) Prior Publication Data

US 2014/0023423 A1 Jan. 23, 2014

Related U.S. Application Data

(60) Provisional application No. 61/674,648, filed on Jul. 23, 2012, provisional application No. 61/719,979, filed on Oct. 30, 2012.

(51) Int. Cl.

| | |
|---|---|
| ***B43K 27/00*** | (2006.01) |
| ***B43K 24/00*** | (2006.01) |
| ***B43K 24/12*** | (2006.01) |
| ***B43K 24/14*** | (2006.01) |
| ***B43K 8/00*** | (2006.01) |
| ***B43K 8/02*** | (2006.01) |
| ***B43K 8/03*** | (2006.01) |
| ***B43K 8/24*** | (2006.01) |
| ***B43K 27/02*** | (2006.01) |
| ***B43K 27/08*** | (2006.01) |
| ***B43K 29/00*** | (2006.01) |
| ***B43K 29/08*** | (2006.01) |
| ***B43K 29/10*** | (2006.01) |

(52) U.S. Cl.

CPC ..... *B43K 27/00* (2013.01); *B43K 8/003* (2013.01); *B43K 8/024* (2013.01); *B43K 8/028* (2013.01); *B43K 8/03* (2013.01); *B43K 8/24* (2013.01); *B43K 24/12* (2013.01); *B43K 27/02* (2013.01); *B43K 27/08* (2013.01); *B43K 29/004* (2013.01); *B43K 29/08* (2013.01); *B43K 29/10* (2013.01)

(58) Field of Classification Search

CPC ..... B43K 27/00; B43K 8/003; B43K 8/024; B43K 8/028; B43K 8/03; B43K 8/24; B43K 24/12; B43K 27/02; B43K 27/08; B43K 29/004; B43K 29/08; B43K 29/10

USPC ..... 401/25–35, 23

See application file for complete search history.

(56) References Cited

U.S. PATENT DOCUMENTS

| | | | | |
|---|---|---|---|---|
| 1,701,263 A | | 6/1927 | Henzel | |
| 1,889,550 A | * | 11/1932 | Hirth | B43K 24/12 401/31 |
| 2,690,738 A | | 10/1954 | Andonov | |
| 3,080,600 A | * | 3/1963 | Stevens | B43K 8/02 401/199 |
| 3,260,242 A | * | 7/1966 | Liguori | B43K 24/10 401/29 |
| 3,397,938 A | * | 8/1968 | Juelss | B43K 8/02 401/198 |

(Continued)

*Primary Examiner* — Mark A Laurenzi
*Assistant Examiner* — Thomas M Abebe
(74) *Attorney, Agent, or Firm* — Vincent Re PLLC

(57) ABSTRACT

A writing device can be configured to provide ink or a colored dye upon a piece of paper or other medium. Such a writing device can include a plurality of selectable writing elements, wherein one of the writing elements comprises marker device comprising an ink reservoir connected to a writing tip.

2 Claims, 11 Drawing Sheets

(56) References Cited

U.S. PATENT DOCUMENTS 3,898,008 A * 8/1975 Ganz ..... B43K 24/146 401/30
3,989,389 A * 11/1976 Hashimoto ..... B43K 24/16 401/30
4,202,641 A * 5/1980 Tomura ..... B43K 27/02 401/32
4,227,822 A * 10/1980 Kokubu ..... B43K 24/146 401/17
4,270,869 A * 6/1981 Sekiguchi ..... B43K 24/18 401/30
4,283,151 A * 8/1981 Sekiguchi ..... B43K 27/02 401/33
4,575,271 A 3/1986 Hashimoto et al.
D295,537 S 5/1988 Davidson et al.
5,048,990 A 9/1991 Hashimoto et al.
5,056,947 A * 10/1991 Kubota ..... B43K 24/146 401/29
5,203,638 A * 4/1993 Redmond, Jr. ..... B43K 27/08 401/117
5,207,523 A 5/1993 Wittek
5,306,085 A * 4/1994 Kobayashi ..... B43K 29/02 15/429
5,549,403 A * 8/1996 O'Shell ..... B43K 24/12 401/29
5,599,122 A * 2/1997 Yu ..... B43K 24/12 401/31
5,713,680 A 2/1998 Yoshino et al.
5,823,697 A 10/1998 Talbot
5,890,825 A * 4/1999 Kageyama ..... B43K 27/02 401/29
5,899,618 A * 5/1999 Kobayashi ..... B43K 1/086 401/29
5,909,975 A * 6/1999 Kobayashi ..... B43K 24/14 401/105
6,033,141 A 3/2000 Blaustein et al.
6,217,241 B1 4/2001 Kobayashi
6,386,780 B1 * 5/2002 Brummernhenrich B43K 29/007 40/334
D472,578 S 4/2003 Plantz et al.
6,554,516 B1 * 4/2003 Christopher ..... B43K 24/163 401/29
6,554,517 B2 4/2003 Ahmed
6,746,167 B2 6/2004 Ahmed
6,877,922 B2 4/2005 Ahmed
6,953,296 B1 10/2005 Vora
7,080,949 B1 7/2006 Yamamoto
8,221,012 B2 7/2012 Rennecker
8,226,312 B2 7/2012 Rennecker et al.
8,322,938 B2 12/2012 Shim
2002/0176731 A1 * 11/2002 Torii ..... B43K 24/163 401/31
2003/0194256 A1 10/2003 Ahmed
2003/0215279 A1 * 11/2003 Katami ..... B43K 24/163 401/31
2005/0063767 A1 * 3/2005 Kobayashi ..... B43K 7/03 401/188 A
2006/0210349 A1 * 9/2006 Lane ..... C09D 11/16 401/198
2006/0222437 A1 * 10/2006 Yamauchi ..... B43K 27/12 401/31
2007/0243010 A1 * 10/2007 Lin ..... B43K 27/08 401/195
2007/0274761 A1 11/2007 Shim
2008/0138139 A1 * 6/2008 Kageyama ..... B43K 5/17 401/108
2009/0257811 A1 * 10/2009 Brachman ..... B43K 1/12 401/34

* cited by examiner

APPARATUS FOR SELECTABLY PROVIDING MULTIPLE COLORS OF INK FROM A MARKER PEN

CROSS REFERENCE TO RELATED APPLICATIONS

This disclosure is claims the benefit of U.S. Provisional Application No. 61/674,648 filed on Jul. 23, 2012 and of U.S. Provisional Application No. 61/719,979 filed on Oct. 30, 2012 which is hereby incorporated by reference.

TECHNICAL FIELD

This disclosure is related to marker pens used to provide colored ink upon paper or other medium.

BACKGROUND

The statements in this section merely provide background information related to the present disclosure. Accordingly, such statements are not intended to constitute an admission of prior art.

Marker pens, magic markers, or felt tip pens are used to apply a colored ink to paper or other medium. The ink can be used decoratively, for example, by a child coloring upon a page. The ink can be used instructively, for example, high-lighting a portion of printed type for quick reference later. Colored ink upon a page has a number of uses.

A marker pen includes a storage medium or reservoir for storing ink for future use. The storage medium protects the stored ink from drying out before being used. According to one example, a storage medium can include a felt cylinder encased along the outer diameter of the cylinder with a plastic sleeve. The felt cylinder connects or is unitary with a writing tip, often an extension of the felt extending out of the pen. According to another example, a small metal tube can hold ink with a structure for dispensing the ink to a writing tip.

Springs are known to be used in ball-point pens to selectively extend or retract a writing tip of the pen. According to one embodiment, a spring is situated around a plastic ink cylinder, and a button mechanism on the side of the pen distant from the writing tip is depressed to cycle the pen between binary settings: writing tip extended and writing tip withdrawn. The cyclic operation of the pen is enabled by a force transformer device near the button mechanism. Force transformer devices are known in the art and translate the force of the button being depressed into a rotational force within the transformer. Such a force transformer device can be described as a rotating catch button pack. A carrier device within the force transformer device rotates with each depression, and the carrier device includes features that mate with reverse matching features upon a selective extension device. As the carrier device turns, the mating features upon the carrier either match with tip extended features or with tip withdrawn features upon the selective extension device. The turning of the carrier device makes the mating features upon the carrier alternate between the features of the selective extension device. In this way, repeated depression of the button cycles the ball point pen between the binary settings.

According to another embodiment, a ball-point pen writing tip can be extended by pushing a slider button toward the writing end of the device. The slider button is spring loaded into the retracted position, and the user depresses the spring when extending the writing tip. When the slider button reaches the fully extended position, a catch is activated holding the slider button in the fully extended position. The catch can be released in one embodiment by a release button or in another embodiment by depression of another slider button.

SUMMARY

A writing device can be configured to provide ink or a colored dye upon a piece of paper or other medium. Such a writing device can include a plurality of selectable writing elements, wherein one of the writing elements comprises marker device comprising an ink reservoir connected to a writing tip.

BRIEF DESCRIPTION OF THE DRAWINGS

One or more embodiments will now be described, by way of example, with reference to the accompanying drawings, in which.

DETAILED DESCRIPTION

Figure 1:
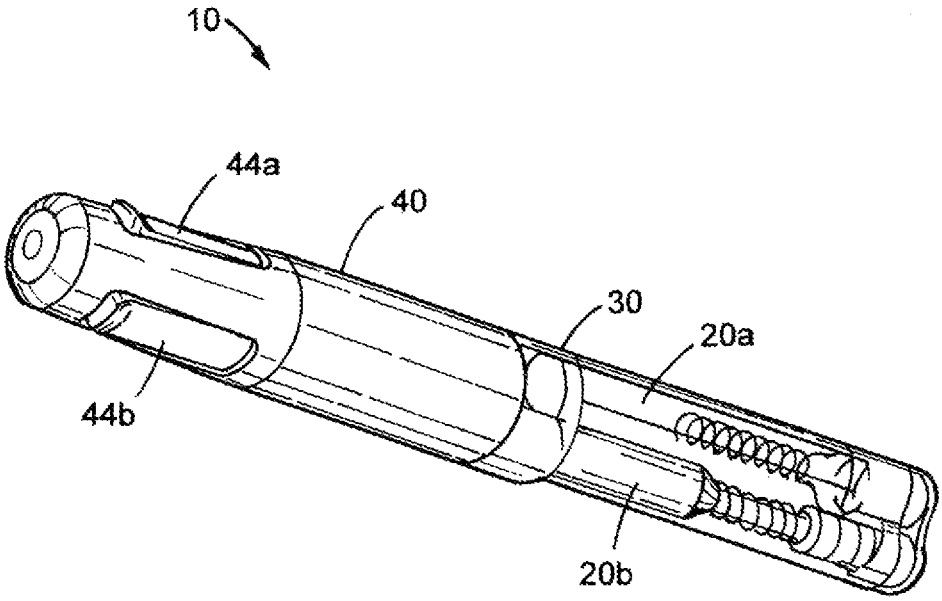
FIG. 1 illustrates an exemplary writing device including a plurality or writing elements, each writing element being configured to selectably extend by depression of a dedicated button, in accordance with the present disclosure.

Referring now to the drawings, wherein the showings are for the purpose of illustrating certain exemplary embodiments only and not for the purpose of limiting the same, FIG. 1 illustrates an exemplary writing device including a plurality or writing elements, each writing element being configured to selectably extend by depression of a dedicated button. Writing device 10 is illustrated including upper housing 40, a transparent lower housing 30, and writing elements 20*a* and 20*b*, each visible through the transparent lower housing 30. Buttons 44*a* and 44*b* are provided, such that depression of either button can cause extension of an associated writing element from a distal end of the writing device. More buttons may be present on a back side of the writing device. Buttons may be spaced at equal intervals around the perimeter of the writing device. In one embodiment, any or all of the writing elements may be simultaneously extended or retracted. In another embodiment, depression of one previously non-depressed button causes a second pre-depressed button to return to a non-depressed state. Transparent lower housing 30 can be entirely transparent, constructed with clear plastic. In another embodiment transparent lower housing 30 can be tinted with a dye, such as blue, green, yellow, etc. to provide a decorative effect. In another embodiment, a translucent or clouded lower housing could be used to provide an alternative decorative effect. In another embodiment, an LED or other light source could be used to make the housing glow, for example, with a timer device lighting the housing for a set amount of time after a button is depressed. In another embodiment, a solid plastic housing without any transparency can be utilized. Lower housing 30 is configured to fit closely to and around the writing elements contained therewithin. A resulting lower housing with a clover-shaped cross section results, with the writing element filling each bulb or leaf of the clover-shape. The lower housing includes a hole for each of the writing elements to extend through. Springs are provided to provide force acting against the depression of the buttons and biasing the writing elements toward a retracted state.

Marker devices are used in the art to apply a swath of ink on a piece of paper or other medium. A marker device frequently includes a felt writing tip or a similar structure, wherein ink from a reservoir can permeate or dampen the felt writing tip. By moving the felt writing tip over the paper, ink is transferred from the tip to the paper. Marker devices can be used to creatively draw, such as a child drawing in a color within the lines coloring book. Marker devices can be used as highlighters, for example, by a student highlighting a portion of a textbook for later easy reference. People that use markers can require that more than one color be available. A child prefers to have multiple colors available with which to draw. Students, such as students in medical school or law school, may need to quickly refer to a particular set of information from a chapter or article, and color coding the highlighted passages can be useful. Similarly, a ball-point pen, a pencil, or a marker device with a different shape of writing tip can be useful. The writing device of FIG. 1 or in other embodiments disclosed herein can provide a plurality of writing elements including at least one marker device, permitting the user to quickly and conveniently switch between the writing elements.

Figure 2:
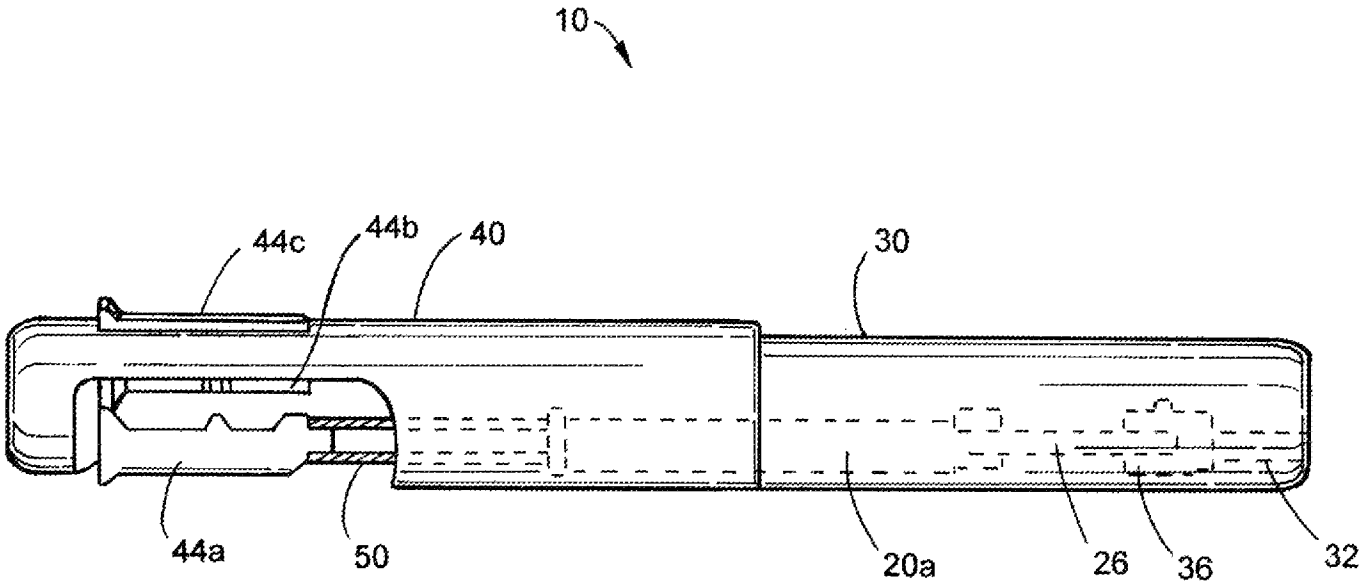
FIG. 2 illustrates the writing device of FIG. 1 including a cut-away section showing interaction of the buttons, in accordance with the present disclosure.

FIG. 2 illustrates the writing device of FIG. 1 including a cut-away section showing interaction of the buttons. Writing device 10 including upper housing 40 and lower housing 30 are illustrated. Buttons 44*a*, 44*b*, and 44*c* are illustrated, with the cut-away section from upper housing 40 permitting illustration of the buttons and connecting hardware within the housing. Connecting rod 50 is attached to button 44*a*, permitting depression of button 44*a* by the user to apply force upon writing element 20*a*. Writing element 20*a* includes a writing tip 26 which can be selectively extended through opening 32. A cap device 36 internal to housing 30 provides a seal to the internal portion of housing 30, such that when a writing element is retracted within the housing, the marker device will not be exposed to ambient air which tends to quickly dry out and ruin a marker device.

Figure 3:
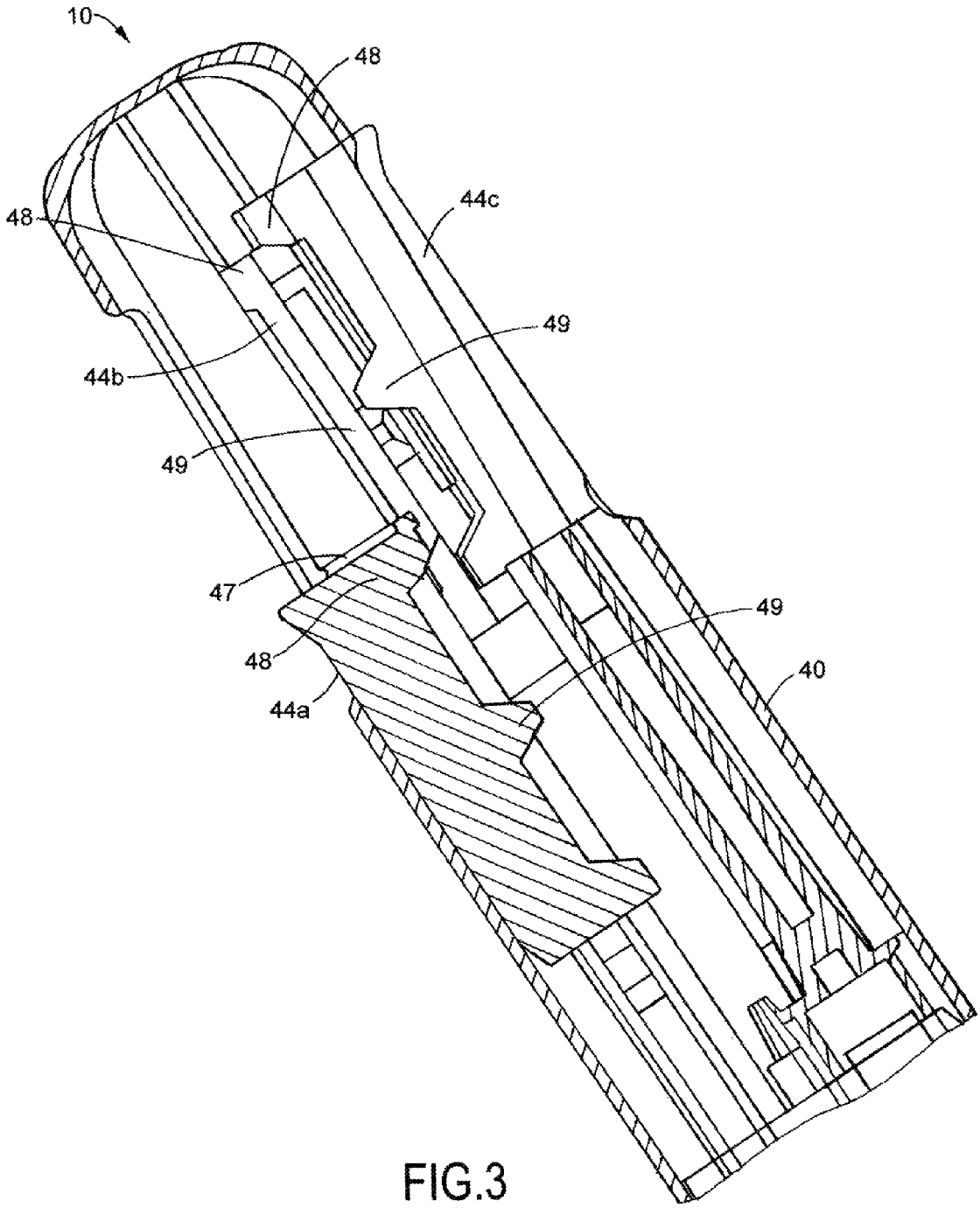
FIG. 3 illustrates the buttons of FIG. 2 in detail including details that hold the buttons down in a depressed state and selectably permit the buttons to return to a non-depressed state, in accordance with the present disclosure.

FIG. 3 illustrates the buttons of FIG. 2 in detail including details that hold the buttons down in a depressed state and selectably permit the buttons to return to a non-depressed state. Writing device 10 is illustrated including upper housing 40 and buttons 44*a*, 44*b*, and 44*c*. Each button includes notch features 48 and 49. Upper housing includes ledge features 47 for each button. When button 44*a* is pushed down into the illustrated depressed position, a top flat surface of button 44*a* catches on ledge feature 47, such that a spring force applied from the associated writing element does not return the button to the non depressed state. Button 44*c* is illustrated in a non depressed state, and button 44*b* is illustrated slightly displaced/depressed from the non depressed state. As button 44*b* would be further depressed, notch feature 49 of button 44*b* would come into contact with notch feature 48 of button 44*a*, thereby displacing button 44*a* from ledge feature 47 and permitting the spring feature of the associated writing element to return button 44*a* to the non depressed state. In this way, depression of one button can cause a second depressed button to return to a non depressed state. Other mechanisms or button arrangements for selectively extending writing elements from a writing device are envisioned, and the disclosure is not intended to be limited to the examples provided herein.

Figure 4B:
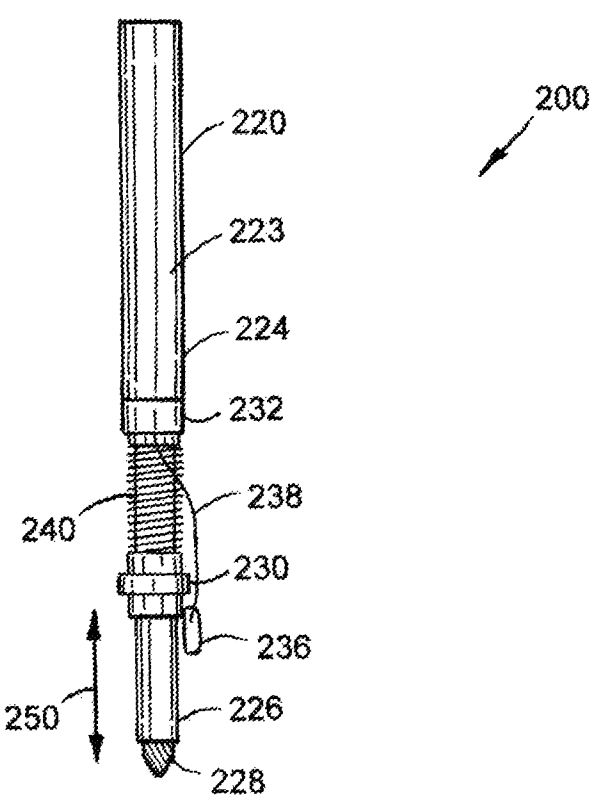
FIG.4B PRIOR ART
FIGS. 4A and 4B illustrate a self-contained capped writing element that can be utilized in a writing device, in accordance with the present disclosure.
Figure 4A:
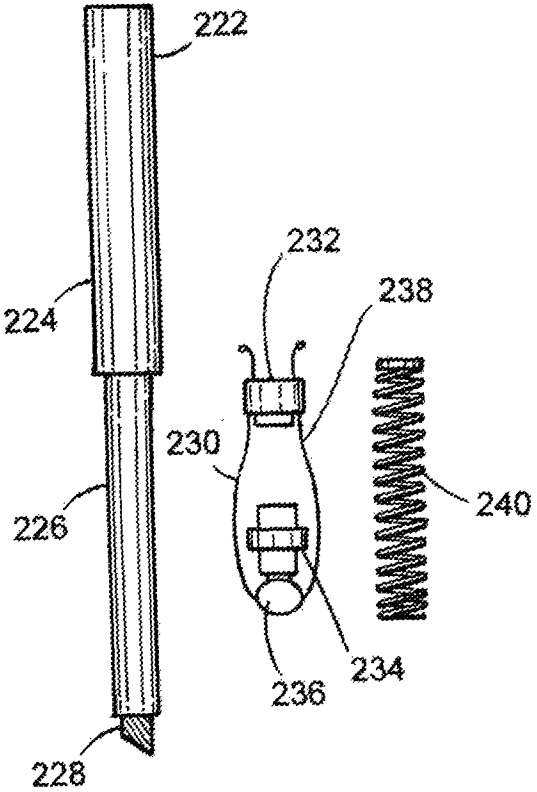
FIG.4A PRIOR ART

A number of writing element configurations can be used within writing devices disclosed herein. According to one embodiment, a spring can be coiled around the writing element to spring load it into a retracted position. The spring can be located on one end to the writing element and an the other end to a fixed feature on the marker, such as the lower housing. FIGS. 4A and 4B illustrate an exemplary writing element with an integrated retracting cap or a self-contained capped writing element. FIG. 4A illustrates components of the writing element and the integrated retracting cap. Self-contained capped writing element 222 includes a wider thick section 224 and a thinner narrow section 226. Writing element 222 also includes writing tip 228. A retracting cap assembly 230 includes base fixture 232 and depression should 234 that are configured to be put over the narrow section 226. Tension lines holding cap 238 are attached to base fixture 232 and to retracting cap 236. Coil spring 240 is also configured to be put over narrow section 226 in between base fixture 232 and depression shoulder 234. Coil spring 240 when installed to narrow section 226 applies a compressive force to base fixture 232 and depression shoulder 234. The tension lines holding cap 238, when the spring is extended to a lengthened or uncompressed state, cause the retracting cap to close over the end of the depression shoulder, thereby capping the writing tip 228 of the writing element 222 therewithin. When depression shoulder is installed to a marker device and located to a fixed feature, pressure applied to a top end of thick section 224 compresses the spring causing the tension lines 238 to go slack and the tip 228 to extend through depression shoulder 234 and push the retracting cap 236 aside. In this way, the writing tip 228 is either encapsulated by the depression shoulder 234 and the retracting cap 236 or it is extended for writing. FIG. 4B illustrates configuration 200 including writing element with an integrated retracting cap 220. Writing element with an integrated cap 220 includes retracting cap assembly 230 installed to narrow section 226 such that base fixture 232 is proximate to thick section 224, thick section 224 including an ink reservoir 223. Writing element with an integrated retracting cap 220 is illustrated with coil spring 240 compressed, such that tension line 238 is slackened and writing tip 228 is extended and has pushed aside retracting cap 236. An ink tip stroke 250 can be defined as the length of narrow section 226 and writing tip 228 that can be projected from the end of retracting cap assembly 230. The ink tip stroke 250 can be configured or selected based upon the requirements of the marker by adjusting the length of the coil spring, the configuration of the retracting cap assembly 230, and the configuration of the narrow section 226.

Figure 5:
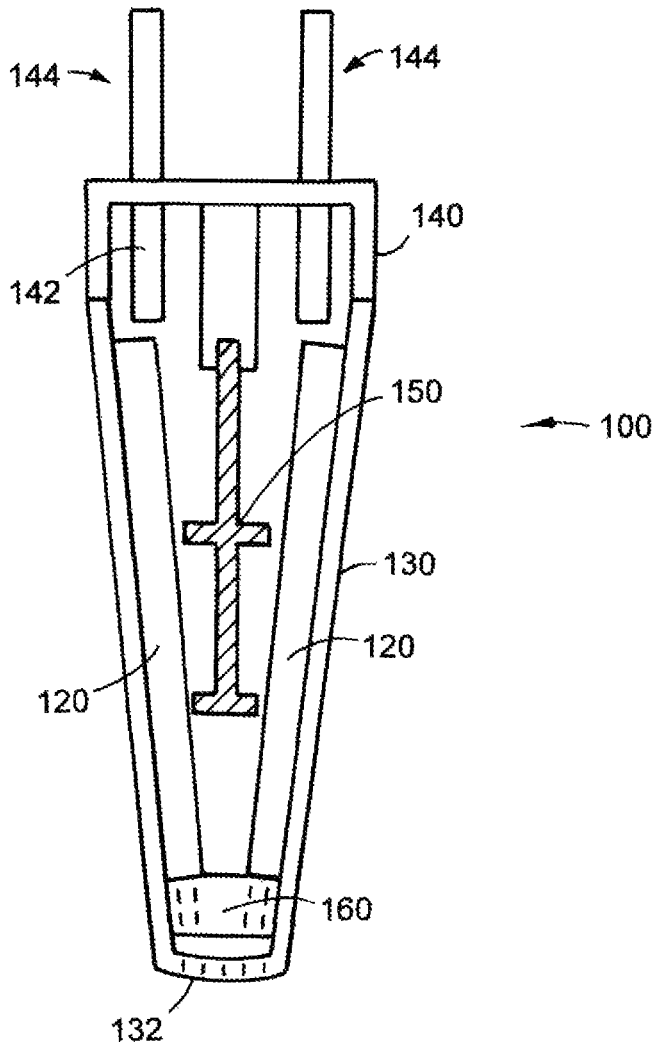
FIG. 5 illustrates a second exemplary embodiment of a writing device including a plurality or writing elements, in accordance with the present disclosure.

FIG. 5 illustrates an exemplary multi-writing element marker, each writing element being configured to selectably extend by depression of a dedicated button. Configuration 100 includes marker 110 which includes a plurality of writing elements 120. Marker 110 includes an upper housing 140 and a lower housing 130 holding the contents of the marker in place. Each writing element 120 includes a dedicated button 144 which can be depressed to extend the respective writing element. According to one embodiment, a button pack 142 including a rotating catch button pack is used for each of the buttons 144 in combination with springs located to the writing elements pushing the writing elements against the button packs 142 in order to enable selective extension of the writing elements.

Writing elements 120 can be held within place within marker 110 by any of a number of methods. According to the exemplary embodiment of FIG. 5, an ink end fixture 160 includes a number of holes through which the writing elements 120 or tips thereof can extend. The holes in the ink end reservoir match with an end hole or end holes 132 in the tip of lower housing 130. Ink end fixture 160 can include details to locate an end of each of the writing elements 120. Writing element fixture 150 is fitted between the writing elements 120 and further locates the writing elements in place while permitting the writing elements to slidingly extend as the buttons are activated. According to one embodiment, writing element fixture 150 can be held in place within marker 110 by a projecting tab of upper housing 140. A number of exemplary configurations of fixtures holding the writing elements in place are envisioned, and the disclosure is not intended to be limited to the particular examples provided herein.

Figure 6:
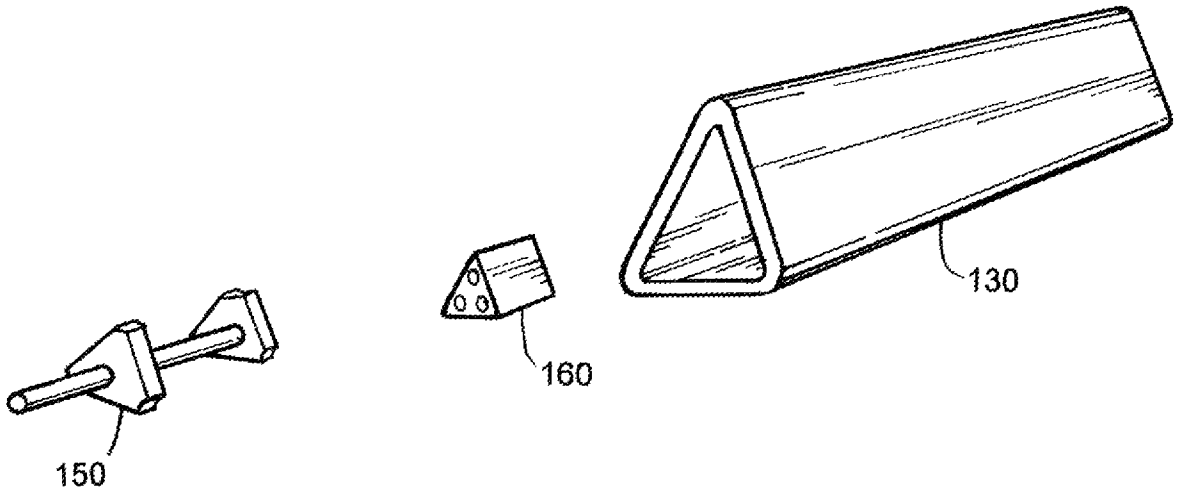
FIG. 6 illustrates components of the writing device of FIG. 5, in accordance with the present disclosure.

FIG. 6 illustrates components of the writing device of FIG. 5. The illustrated configuration includes lower housing 130 ready to receive ink end fixture 160 and writing element fixture 150. In the exemplary configuration 300, the lower housing is illustrated as a triangular cone configured to receive three ink reservoirs. One having skill in the art will appreciate that different shapes can be used depending upon how many ink reservoirs are to be used in the marker. By angling the lower housing toward the writing end of the marker, the tips of the ink reservoirs are focused toward a common area. This angle makes the marker easier to grip, with the thinner section near the tip. Further, with the writing tips extending into a similar area, the marker can be used more easily than if the writing tips were located in different areas, for example, permitting the pen to held similarly while different writing tips are extended.

Figure 7:
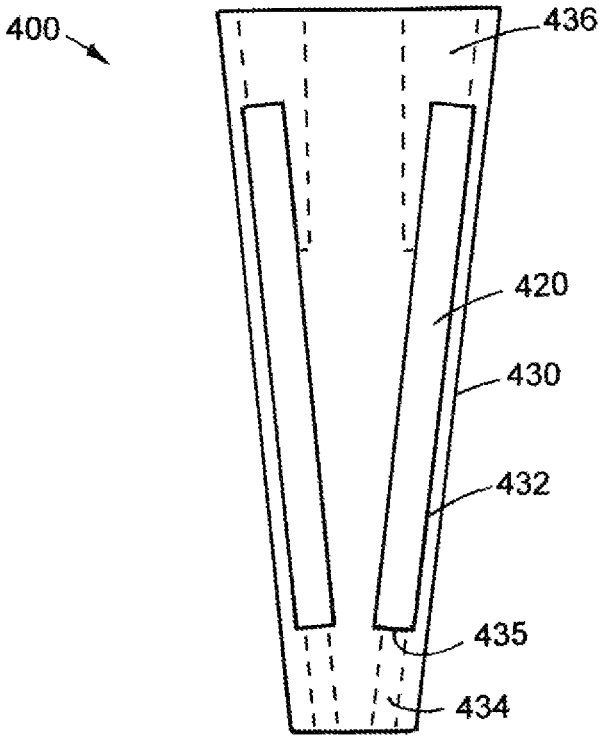
FIG. 7 illustrates an exemplary housing that can be utilized with a third exemplary embodiment of a writing device including a plurality or writing elements, in accordance with the present disclosure.

FIG. 7 illustrates another exemplary embodiment of a lower housing that can be used with a multi-writing element marker device. Configuration 400 includes lower housing 430 which includes initially a single, solid block. Sections can be drilled out of the solid block to permit ink reservoirs to be inserted and to extend and retract as required for operation of the marker, and sections can be drilled out for operation of the marker mechanisms such as button packs. Writing elements embodied as ink reservoirs 420 are illustrated within drilled out sections for ink reservoirs 432. Drilled out tip for extension of tip of ink reservoir 434 are illustrated and permit the writing tips of the ink reservoirs to extend through the holes in the tip. Shoulders or changes in hole diameters for ink reservoir extension 435 are illustrated, showing a fixed feature that can be pressed against to compress a spring around the ink reservoir. Drilled out sections facilitating operation of button packs 436 are illustrated. A number of exemplary lower housing configurations are envisioned depending upon the particular ink reservoirs, the particular button configurations, and the other particular marker configuration details of a marker, and the disclosure is not intended to be limited to the particular examples provided herein.

Upper and lower housings can be joined according to a number of methods known in the art, including a threaded pattern on one housing matching a threaded pattern on the other housing, adhesives, sonic or heat welding, or other methods known in the art.

Figure 8A:
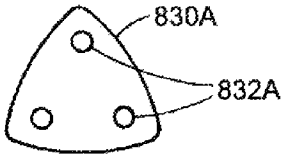
FIGS. 8A-8E illustrate exemplary writing device configurations that can be utilized, in accordance with the present disclosure.
Figure 8B:
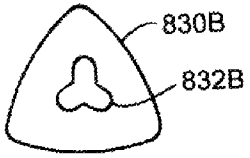
Figure 8C:
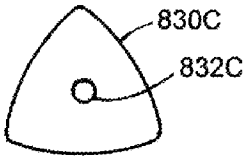
Figure 8D:
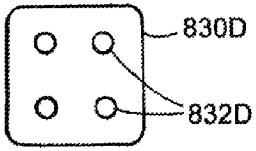
Figure 8E:
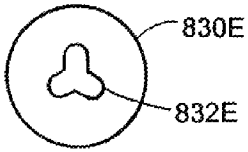

FIGS. 8A-8E illustrate exemplary writing device configurations that can be utilized. FIG. 8A illustrates a writing device with a housing 830A including a triangular cross-section. Such an exemplary writing device can include three writing elements, one included within each portion of the housing associated with an apex in the triangular shape. Each writing element includes a dedicated hole 832A. FIG. 8B illustrates a writing device with a housing 830B including a triangular cross-section. Such an exemplary writing device can include three writing elements, one included within each portion of the housing associated with an apex in the triangular shape. An opening 832B is illustrated including a clover-leaf shaped perimeter. Opening 832B permits a plurality of writing elements to be angled within the pen to exit from opening 832B without requiring that each of the writing elements extend through a single hole. Such a configuration can be beneficial, as flexibility in the location though which the tip of the writing element extends through the housing can reduce an extension stroke length that the writing element must travel in order to alternate between extended and not extended states. FIG. 8C illustrates a writing device with a housing 830C including a triangular cross-section. Such an exemplary writing device can include three writing elements, one included within each portion of the housing associated with an apex in the triangular shape. The writing device includes a single hole 832C through which each of the writing elements can extend. FIG. 8D illustrates a writing device with a housing 830D including a square-shaped cross-section. Such an exemplary writing device can include four writing elements, one included within each portion of the housing associated with an apex in the square shape. Each writing element includes a dedicated hole 832D. FIG. 8E illustrates a writing device with a housing 830E including a circular cross-section. Such an exemplary writing device can include any number of writing elements. An opening 832E is illustrated including a clover-leaf shaped perimeter similar to opening 832B of FIG. 8B, permitting three exemplary writing elements to extend through opening 832E. A number of alternative embodiments are envisioned. For example, two writing elements within a device can include a housing with an oval or rectangular-shaped housing. As illustrated in FIG. 1, a housing can include a clover-shaped cross-section, with a bulb or leaf of the clover-shape including one writing element. A star-shaped housing can be used with five writing elements. A plurality of types of writing elements can be utilized, for example, with a triangular-shaped housing including a marker device writing element, a ball-point pen writing element, and a mechanical pencil writing element. In such an embodiment, different configurations of holes and optional associated caps can be utilized, for example, with the marker device writing element including a wide hole with an integrated cap design and with the pen and pencil writing elements including smaller openings without caps. A number of alternative embodiments are envisioned, and the disclosure is not intended to be limited to the examples provided herein.

Figure 9:
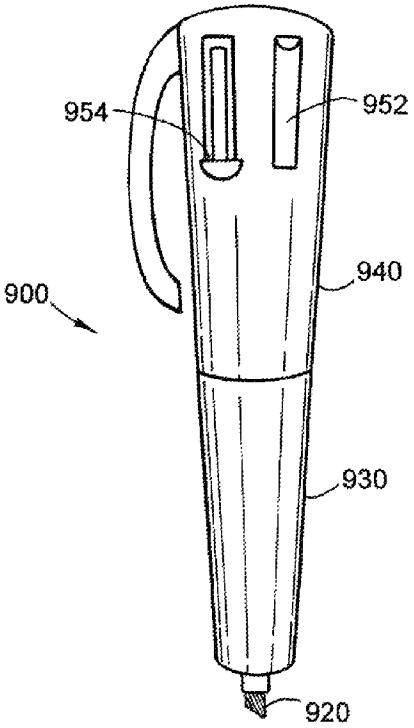
FIG. 9 illustrates a fourth exemplary embodiment of a writing device including a plurality or writing elements, in accordance with the present disclosure.

FIG. 9 illustrates a fourth exemplary embodiment of a writing device including a plurality or writing elements. Writing device 900 is provided including a plurality of buttons 952 and 954 that can be selectively depressed to extend an associated wiring element 920 through a single hole in the end of the writing device 900. Writing element 920 is illustrated as an exemplary marker device such as a highlighter marker. Writing device 900 includes exemplary upper housing 940 and lower housing 930. A number of exemplary writing device configurations are envisioned, and the disclosure is not intended to be limited to the particular examples provided herein.

Figure 10:
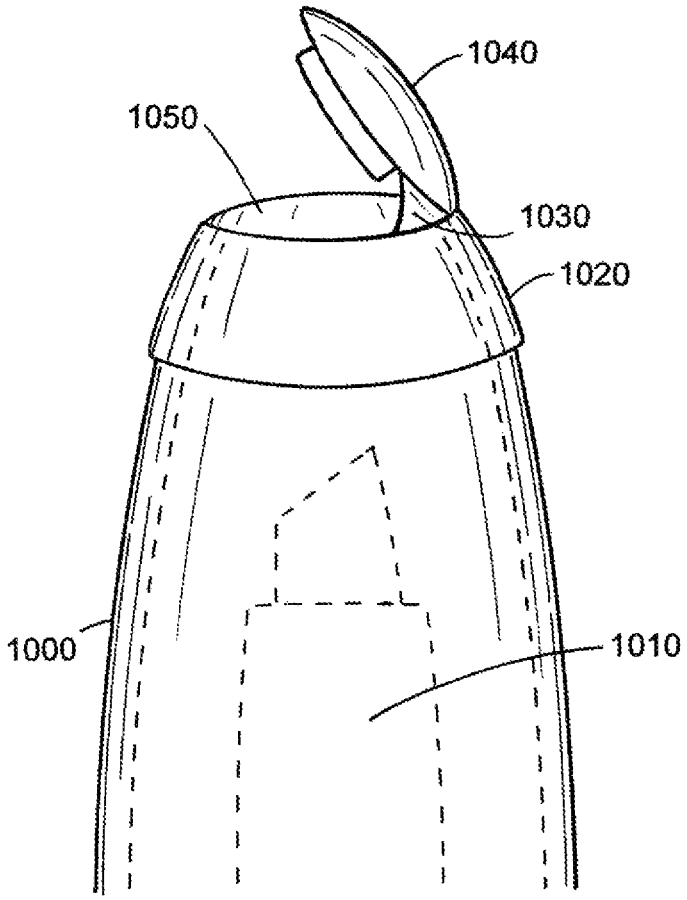
FIG. 10 illustrates an exemplary cap that can be provided upon a writing device, in accordance with the present disclosure.

FIG. 10 illustrates an exemplary cap that can be provided upon a writing device. An exemplary writing device is illustrated including housing 1000, writing element 1010, and hole 1050 through which writing element 1010 can extend. An over-molded polymer cap 1020 is illustrated. Housing 1000 can include a hard plastic created by an injection molding process known in the art. A process known as a two-step injection molding process can include placing housing 1000 within an injection mold tool and injecting a second softer polymer material upon and around a portion of housing 1000, such that the second material is adhered to the housing in a desired shape. According to one embodiment, the second material can have similar elastic properties to a rubber band. Cap 1020 is created upon an end of housing 1000 according to such a two-step injection molding process. Cap door 1040 is illustrated including an elastic section 1030, such that cap door 1040 is biased toward closing opening 1050. When writing element 1010 is extended through opening 1050, the element can displace cap door 1040. An exemplary writing device with one hole is illustrated. Similar configurations are envisioned, for example, with a single over-molded polymer cap including a plurality of cap doors covering a plurality of holes on the writing device.

Figure 11:
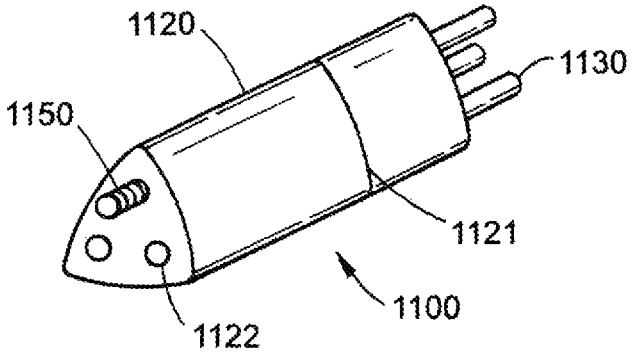
FIG. 11 illustrates a fifth exemplary embodiment of a writing device including a plurality or writing elements, in accordance with the present disclosure.

FIG. 11 illustrates a fifth exemplary embodiment of a writing device including a plurality or writing elements. A writing device 1100 with housing 1120 and three independent writing elements 1150, each with a dedicated button 1130 and a dedicated hole 1122 in the end of the housing, is illustrated. Exposed writing element 1150 is illustrated. A segment in the housings 1121, permitting easy construction and assembly of housing 1120 and the illustrated upper housing, is illustrated.

Figure 12:
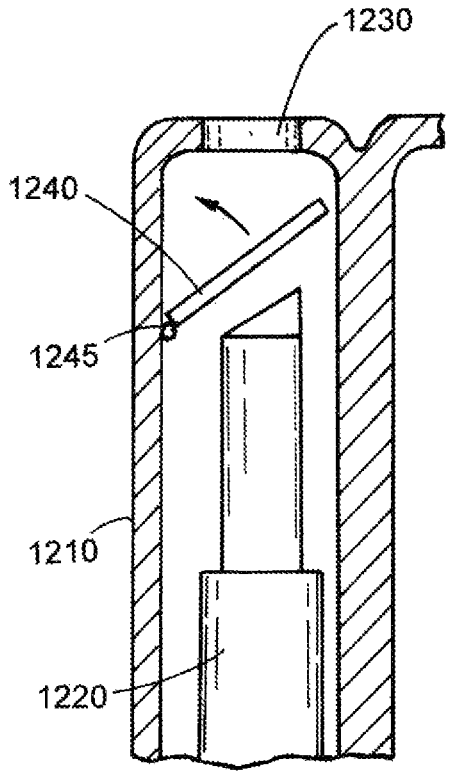
FIG. 12 illustrates an exemplary trap door cap that can be utilized internal to a writing device, in accordance with the present disclosure.

FIG. 12 illustrates an exemplary trap door cap that can be utilized internal to a writing device. An exemplary writing device including housing 1210 and writing element 1220 is illustrated. Writing element is configured to selectably extend according to devices of the present disclosure. Trap door cap 1240 is illustrated including hinge 1245 permitting the door to alternate between a closed position as illustrated and an open position indicated by the arrow. According to one embodiment, hinge 1245 can include a torsional spring biasing the door in the closed position, and wherein the writing element, when extended, can overcome the bias of the spring to open the door. Hole 1230 is provided through which the writing element 1220 can extend. Door 1240 and hinge 1245 can be situated and aligned within the writing device according to a number of configurations. According to one embodiment, an insert including the hinge and the door can be inserted within housing 1210 and situated proximate to hole 1230.

Writing elements can be fixed within a writing device, such that the user cannot open the device and/or such that the device is disposable once the ink reservoir for a particular element is exhausted. In another embodiment, the device can be opened by the user, and an exhausted or dried out writing element can be replaced. Individual replacement writing elements can be provided to the user. In one embodiment, a pen with cavities for three writing elements could be provided to the customer with nine writing elements, including instructions to the user on how to replace writing elements. In one embodiment, such a set of nine writing elements could include nine different colors, for example, permitting a parent to change writing colors for a child's writing device at the request of the child. In another embodiment, commonly used colors, such as yellow for highlighting, can be provided in greater numbers, and a few writing elements of other colors such as pink and green can be provided to complete the set. Alternatively or additionally, ball-point pen writing elements or mechanical pencil writing elements, configured to fit in a same sized cavity as one of the marker devices, can be provided.

Caps are disclosed herein to be internal to the writing device, adhered externally to the writing device, or a cap can be a separate piece attachable to the device. In one embodiment, a separable cap can be a rubberized piece with three posts matching three exemplary holes in the end of the device, such that when the three posts are inserted into the holes, the writing elements within the device are protected from drying out.

Writing elements with particular or minimum tip strokes or distances that the writing tip can be extended must be selected for a particular writing device based upon how far the tip must be extended for the particular device.

Writing elements disclosed herein include marker devices. Marker devices are known in the art that include ink configured to write upon a dry erase board. Wherein embodiments disclosed herein are configured to write upon paper or other mediums, any embodiment including a dry erase marker is enabled to write upon a dry erase board. Embodiments disclosed herein can be configured to use dry erase markers or any other configuration of marker device, and the disclosure is not intended to be limited to the particular examples provided herein.

The disclosure has described certain preferred embodiments and modifications of those embodiments. Further modifications and alterations may occur to others upon reading and understanding the specification. Therefore, it is intended that the disclosure not be limited to the particular embodiment(s) disclosed as the best mode contemplated for carrying out this disclosure, but that the disclosure will include all embodiments falling within the scope of the appended claims.

The invention claimed is:

1. A writing device comprising a plurality of selectable writing elements, the device comprising:

three separately extendable writing elements, wherein at least two of the writing elements each comprise a marker device;

a housing with a rounded triangular cross section and with three holes upon a terminal end of the housing, each hole providing an outlet hole for one of the writing elements.

2. The writing device of claim 1, wherein each of the holes comprises a spring activated trap door cap.

* * * * *